United States Patent [19]

Knox et al.

[11] 4,176,712

[45] Dec. 4, 1979

[54] YARN HEATING APPARATUS AND PROCESS

[75] Inventors: Lee H. Knox; Malcolm P. Owens, both of Charlotte, N.C.

[73] Assignee: Fiber Industries, Inc., New York, N.Y.

[21] Appl. No.: 867,735

[22] Filed: Jan. 9, 1978

Related U.S. Application Data

[62] Division of Ser. No. 226,063, Feb. 14, 1972, Pat. No. 3,736,469.

[51] Int. Cl.[2] ..... F28D 15/00

[52] U.S. Cl. ..... 165/105; 57/309; 165/133

[58] Field of Search ..... 165/133, 105; 57/34 HS

[56] References Cited

U.S. PATENT DOCUMENTS

| | | | |
|---|---|---|---|
| 2,923,640 | 2/1960 | Buckingham | 165/133 X |
| 3,071,838 | 1/1963 | Scragg | 57/34 HS |
| 3,177,931 | 4/1965 | Carruthers | 165/65 |
| 3,367,006 | 2/1968 | Mattingly | 57/34 HS |
| 3,466,189 | 9/1969 | Erb | 165/133 X |
| 3,547,185 | 12/1970 | Eissenberg | 165/1 |
| 3,682,238 | 8/1972 | Ostertag et al. | 165/1 |

OTHER PUBLICATIONS

First Int'l Symposium on Water Desalination, Erb and Thelen, Oct. 1965, p. 4.

*Primary Examiner*—Albert W. Davis, Jr.
*Assistant Examiner*—Margaret A. Focarino
*Attorney, Agent, or Firm*—Roderick B. Mac Leod

[57] ABSTRACT

There is provided an improved heating apparatus of the multiple condensing-vapor substantially air-free type used for uniformly heating moving threadlines of yarn up to 350° C. and which includes a pressurized boiler containing a vaporizable liquid, means for heating the liquid in the boiler to generate hot vapor, means for distributing the hot vapor to the inside of multiple plates where the vapor condenses and thereby heats threadlines of yarn separately moved in frictional contact witn an outer yarn-contacting surface of each hot plate, and possibly means for returning the condensate to the boiler, wherein the improvement comprises having a coating on the inside surface of each said hot plate, said coating having a contact angle with said vaporizable liquid of at least 90°.

8 Claims, 7 Drawing Figures

ELECTRICAL HEATER TEMPERATURE PROFILE
(With door closed and Set Point at 180° C)

SCHEMATIC-VAPOR HEATING SYSTEM

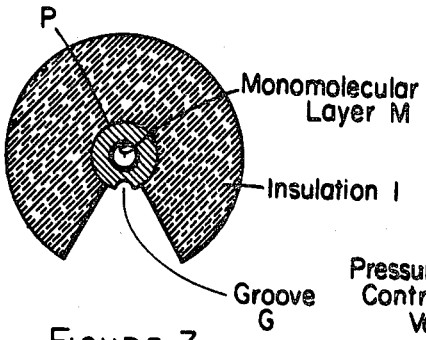
FIGURE 3
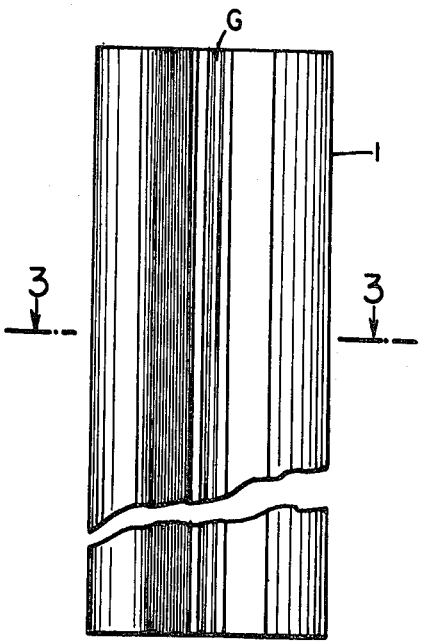
FIGURE 4
FIGURE 5
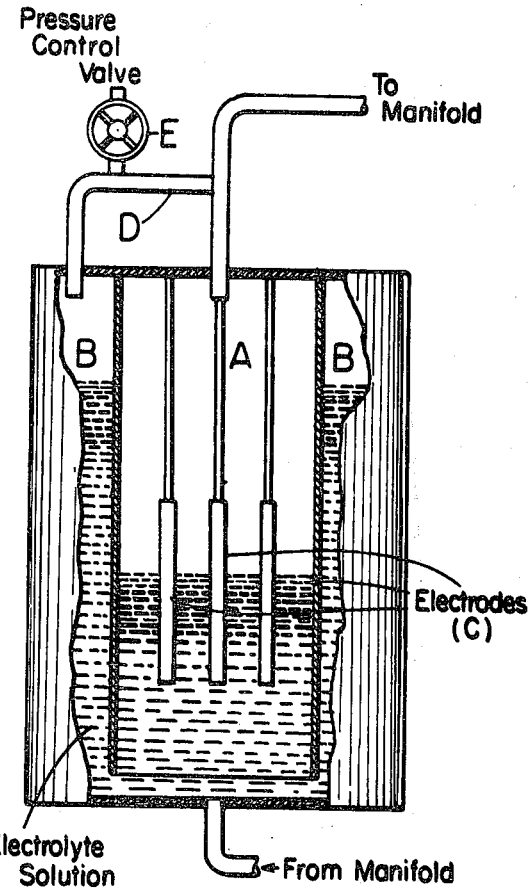

SURFACE TEMPERATURE MEASUREMENTS
(Made with ALNOR Surface Pyrometer Doors Open)

SURFACE TEMPERATURE MEASUREMENTS
(Made with Thermocouple and Mini-Mite Potentiometer)

YARN HEATING APPARATUS AND PROCESS

This is a divisional application of application Ser. No. 226,063, filed Feb. 14, 1972 now U.S. Pat. No. 3,736,469.

BACKGROUND OF THE INVENTION

This invention relates generally to a heating system for multiple position plate heaters utilizing vapor condensing at the same pressure throughout the system. More particularly, the invention relates to a condensing steam heating apparatus for synthetic yarn processing, and process therefor, having a very high overall coefficient of heat transfer even when the yarn is under the yarn-contacting heating surface.

As is well-known, vapor condensing systems are more suitable than electrical heating systems where it is necessary to heat uniformly moving threadlines of yarn such as polyester by means of contact with a hot plate. This is particularly so when adjacent positions are operated at different heat loads on account of different threadline deniers, number of threadlines etc. and most particularly so when the heating surface is approximately vertical. For example the temperature profile of an electrically heated hot plate of a commercial texturizing machine was determined under various conditions and the results are shown in FIG. 1. The hot plate is 4 ft. long and 1 inch broad, has two threading grooves and a matte chrome finish, is in the vertical position and is enclosed by a door to prevent heat escaping and draughts from changing the temperature profile; and has uniform electrical heating (6 volt, 30 amps) along its length. Without any yarn running on the hot plate and the thermostat at the top of the plate set to 180° C., it can be seen that the bottom of the hot plate is at about 110° C., i.e. there is a 70° C. temperature differential. With one threadline of yarn running downwards on the plate the temperature differential is reduced to 40° C., and with two threadlines the temperature differential is reduced to 20° C. By having non-uniform electrical heating along the length of the hot plate it is possible to marginally reduce the temperature gradient for a given set of fixed conditions (threadline speed, number of threadlines etc.), but such a system is still highly inflexible and the product made from a twin threadline process cannot be merged with the product from a single threadline process (e.g. caused by one of the threadlines breaking or running out) on account of its significantly different properties such as ability to absorb dye etc.

Various heating systems of the vapor condensing type have been devised, and include, for example, that disclosed in U.S. Pat. No. 3,177,931 which claims "In apparatus for modifying heat-settable yarns, the combination comprising closed means including a source of vaporized heating fluid substantially completely free of incondensable gases, and a plurality of tubular members for receiving said fluid from said source, said tubular members being disposed in close adjacent side-by-side relation and being inclined for drainage of condensate back to said source, a yarn guide conduit in the form of an open trough generally v-shaped in transverse section and extending along and seated directly upon said tubular members with opposite sides thereof respectively engaging said tubular members for being heated thereby and means for drawing said yarn lengthwise of said tubular means and conduit in contact with the latter for being heated thereby." However, it has hitherto been considered both unnecessary and undesirable in such condensing vapor systems to have the yarn under the heating surface, because of the greater temperature variability resulting from the increase in thickness of the condensation film between the vapor and the plate heating the yarn. Accordingly none of the prior art of which the applicant is aware discloses a vapor condensing hot plate with the yarn running under the hot plate, e.g. FIG. 6 of the forementioned U.S. Pat. No. 3,177,931.

The applicants have now discovered that there would be certain processing advantages in having the yarn run under the vapor heated hot plate. In particular, when hot plates several feet long are used on a multiposition machine it is very much easier for the operator of the machine to string-up the threadline on the underside of a plate inclined at, say, 30° to the vertical than to string-up a machine which is similar except that it has vertical hot plate. Longer hot plates may be used and thereby higher processing speeds. Also heat losses are marginally reduced: according to "The Efficient Use of Steam" by Oliver Lyle (H.M. Stationery Office), Table XXVI on page 853, heat losses are roughly proportional to the square of the air velocity, and the convection air velocity adjacent to a vertical hot plate is greater than the convection air velocity for the underside of the same hot plate inclined to the vertical.

SUMMARY OF THE INVENTION

It is therefore an object of the instant invention to provide a multiple condensing vapor heating system which not only heats yarns uniformly at varying heat loads by virtue of a high overall coefficient of heat ransfer, but in addition permits such yarn heating processes to be operated at maximum speeds in the simplest possible manner by the operator, with minimum waste of heat and with minimum maintenance, by a technique which may include the yarn being under the yarn-contacting heating surface.

Very surprisingly the applicant has now found that such a system is achieved by incorporating a trace of a so-called filming amine into mineral-free heating-fluid which causes the vapor to condense as discrete droplets rather than a film. Also it is preferred to use a sealed closed-loop heating system with the vapor entering at the top of each hot plate, and with the condensate returning from the bottom of each hot plate to a single package boiler which heats the liquid directly by passing an electric current through the liquid. Many filming amines, such as octadecylamine, are themselves effective in preventing corrosion by the traces of gases such as oxygen and carbon dioxide that remain within the system even after the application of high vacuum at start-up; but sometimes it may be desirable to include a so-called neutralizing amine in addition. Many different heating fluids may be used, but steam is particularly convenient at temperatures up to 350° C.

BRIEF DESCRIPTION OF THE DRAWINGS

FIG. 3 and FIG. 4 illustrate a typical vapor-heated plate heater.

FIG. 5 illustrates a typical electric resistance heating boiler.

Figure 1:
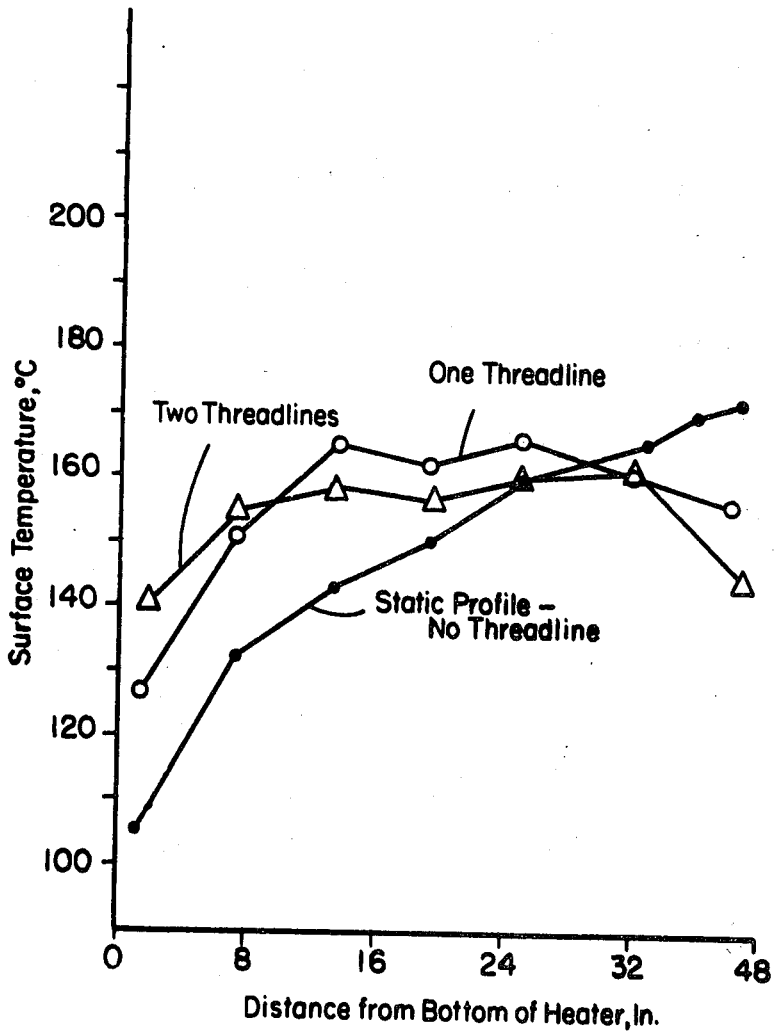
FIG. 1 illustrates the high temperature gradients of prior art vertical electrical heaters.

All of the foregoing are described in detail below, particularly in the examples.

DETAILED DESCRIPTION OF THE INVENTION

The improved heating system of the instant invention is applicable to any process wherein synthetic yarn is processed at elevated temperatures on a multiposition machine, and where, for reasons of product uniformity and mergability, it is essential to maintain very good temperature control on all positions. The invention is exemplified with respect to its applicability to a multiposition drawtwister, but of course is obviously applicable to numerous other process steps involving heat treatment of at least one moving threadline, whether twisted or untwisted; whether the threadline is being stretched, shrunk or treated at constant length; and whether or not each threadline is subsequently or concurrently comingled, interlaced, entangled, twisted with or otherwise intimately joined together with another threadline which may or may not have been treated by the process of the instant invention.

The preferred apparatus of the instant-invention differs principally from prior art heating condensing vapor heating systems for synthetic yarn processing by virtue of two improvements: firstly, the inside surface of the hot plate has a coating which has a contact angle with the condensed vapor in excess of 90°; and secondly, the yarn-contacting surface is substantially under the vapor in the hot plates (the term "substantially under" is meant to include all angles of inclination to the horizontal of the yarn contacting surface up to 85°).

The first improvement of having a coating on the inside surface, which coating has a contact angle with the condensed vapor in excess of 90°, ensures that the vapor condenses as discrete droplets (rather than as a film) which are rapidly removed by gravity, and thereby permits very efficient heat transfer without high temperature gradients. When the heating fluid is steam the coating can be conveniently achieved by incorporating a trace of a "filming amine" into the mineral-free heating fluid. Filming amines are discussed in the "Betz Handbook", p. 202–203 and their use in promoting heat transfer is therein described. Filming amines function by forming on the metal surfaces contacted an impervious non-wettable film of substantially monomolecular thickness, across which the temperature drop is insignificant. The film thickness does not increase in thickness with continued treatment. In addition to providing a thin non-wetting surface many filming amines are therefore effective in preventing corrosion by oxygen and carbon dioxide, traces of which may be present even though the system has been evacuated at the initial charging of the vaporizable fluid. The filming amines of value in the prevention of corrosion are the high molecular weight amines and amine salts having straight carbon chains containing 10–18 carbon atoms, such as octadecylamine ($C_{18}H_{37}NH_2$), hexadecylamine ($C_{16}H_{33}NH_2$) and dioctadecylamine ($C_{36}H_{74}NH$). Octadecylamine is particularly suitable. Since filming amines have the ability to loosen and remove old corrosion films, they may therefore be used to preclean the inside of the boiler, pipes and hot plates etc. Filming amines are reasonably stable at high temperatures and it is believed a self-enclosed system could be operated for several years without any need to replace the contents thereof. In any event samples could be taken occasionally to determine the extent of any decomposition. The amount of filming amine needed never exceeds 100 parts per million based on the weight of water present, and in practice it is most preferred to use less than 15 parts per million.

Instead of using steam and a filming amine, it may sometimes be preferable to use diphenyl ether containing trace amounts of polyethylene glycol, on account of the lower pressure obtainable at a given temperature with such a system.

With regard to the second improvement it is preferred to use inclination angles of from 45° to 85° in conjunction with from 2 feet to 10 feet length of yarn contacting surface; it is most preferred for the yarn-contacting surface to be inclined at an angle from 55° to 75° to the horizontal in conjunction with from 3 feet to 6 feet length of yarn-contacting surface. It is also preferred that all the yarn-contacting surfaces on the multiposition machine should lie substantially in a single plane which is inclined to the horizontal. The foregoing conditions both reduce heat losses and permit quick and simple string-up of the threadlines by the operator.

If desired trace amounts of a "neutralizing amine" may also be added in addition to the filming amine, e.g. those described in the "Betz Handbook" at page 200 and including cyclohexylamine ($C_6H_{11}NH_2$) and morpholine ($C_4H_9NO$). These amines volatilize with the steam and combine with the carbon dioxide in the condensate to neutralize its acidity.

Figure 2:
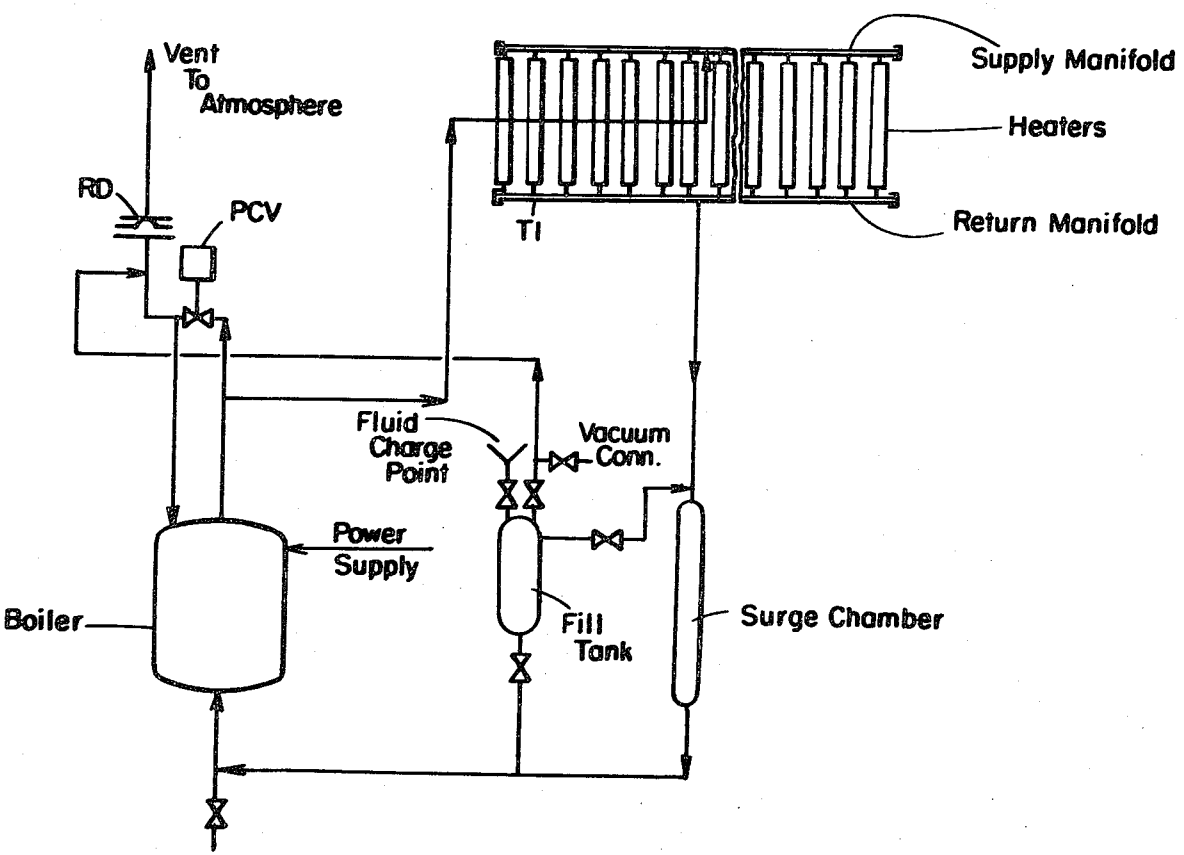
FIG. 2 is a schematic diagram of a multiple position plate heater system utilizing vapor condensing at the same pressure throughout the closed-loop system.

It is preferred to use a sealed closed-loop heating system such as that shown in FIG. 2 with the vapor entering at the top of each hot plate, and with the condensate returning from the bottom of each hot plate to a single boiler. This ensures that make-up problems are kept to a minimum. It is also preferred to use a single package boiler (FIG. 2) which heats the liquid directly by passing an electric current through the liquid (FIG. 5). The boiler need be controlled by a single thermostat only, with reduction in capital cost as compared wih the electrical system which needs a separate controller on each hot plate.

It is preferred to run the yarn along a groove (FIGS. 3 and 4) in the wall of the heating tube rather than have a separate wear plate seated thereon, in order to reduce the resistance to heat transfer. It is preferred to have this groove treated with a ceramic coating such as chromium oxide, titanium oxide, aluminum oxide or a combination of these in order to increase its life during operation to several years.

The following examples illustrate but do not limit the invention.

EXAMPLES I–VI

A twelve position hot plate system with each hot plate positioned between a feed roll and a draw roll of a standard drawtwist machine is constructed in the following way.

The condensing steam heater system consists as shown in FIG. 2 of a high pressure boiler which supplies steam at a controlled pressure and temperature to a manifold which consists of a row of pipes that act as heaters. Steam condenses in the pipes inclined at an angle of 60° to the horizontal and the resulting condensate flows by gravity back through the surge chamber to the boiler where it begins another cycle. Construction of the manifold is such that a 39 inch section of pipe is available at each position on the drawtwister and acts as a heater. Some heaters are equipped with removable wear plates which are grooved to provide a yarn track. Others heaters consist of only a grooved steam pipe which is lagged except for the front (see FIGS. 3 and 4). To insure good yarn contact from top to bottom each heater surface exhibits a uniform convex curvature $\frac{3}{8}'' \pm 1/16''$ from straight at the mid-point. This curvature remains in the heaters at elevated temperatures, e.g. 250° C.

Steam is supplied to the manifold by a high pressure steam boiler manufactured by Electric Boiler Corporation (EBCOR). The EBCOR boiler (FIGS. 2 and 5) consists of a pressure tank in which a cylinder, open at the bottom, is welded to the inside upper head of the tank thus dividing the tank into two concentric chambers, a steam generating chamber, (A) and a regulating chamber (B). Three solid alloy electrodes (C) are suspended equidistant apart in the chamber, each forming an apex of a triangle. Chambers (A & B) are connected by a steam header (D) in which there is a pressure control valve which is normally open (E of FIG. 5 and PVC of FIG. 2). When not operating, the water seeks a common level in each chamber, covering the top of the electrodes. A small amount of potassium chloride and five parts per million by weight of octadecylamine is added to the water upon initial start-up. The potassium chloride increases the flow of current through the water between the electrodes, and the octadecylamine promotes dropwise condensation. Heat is produced by the electrical resistance of the water. Steam is generated in Chamber (A) and passes to the steam-consuming load. As it builds up in excess of load requirements, it passes through the heater and through the pressure regulator to Chamber (B). As the actual pressure reaches the set pressure, the regulator starts to close. As it reaches this unbalanced condition, the water level drops in Chamber (A), and rises in Chamber (B), uncovering part of the electrodes resulting in less consumption of electricity until such time as the steam is made at a rate equal to the requirement. This is a unique method of modulating the electric power in exact balance with the loads without off-on high-maintenance switches, and without excessive electrical demand. Target temperatures are set by a control which determines the pressure at which the control valve closes. The temperature is the corresponding temperature of saturated steam at this pressure. The steam boiler is also provided with a rupture disc (RD of FIG. 2) in case of excessive pressure buildup in the boiler.

Prior to start-up and pressurizing, the steam system is evacuated with an auxiliary vacuum pump (FIG. 2) to rid the system of air. The system requires about two hours to heat up from a cold start. Once up to temperature, a current of about fifty amps is required from the power supply (FIG. 2) to maintain set point temperature with no load on the system. To change from one set point temperature to another of 50° C. higher requires about twenty minutes. Due to the simplicity of the steam system virtually no maintenance is required. The pressure control valve is a "bellows" packless type (PCV of FIG. 2).

Temperature measurements of the hot plates were made with an ordinary thermocouple and also with an Alnor surface pyrometer. The measurements made with the surface pyrometer (FIG. 6) showed less of a temperature gradient from top to bottom than did the measurements made with the thermocouple (FIG. 7). This can be explained by the greater effect of convection currents on the thermocouple junction, particularly at the bottom of the hot plate, whereas an Alnor sensing head, being insulated from convection currents, shows less of a gradient.

Figure 6:
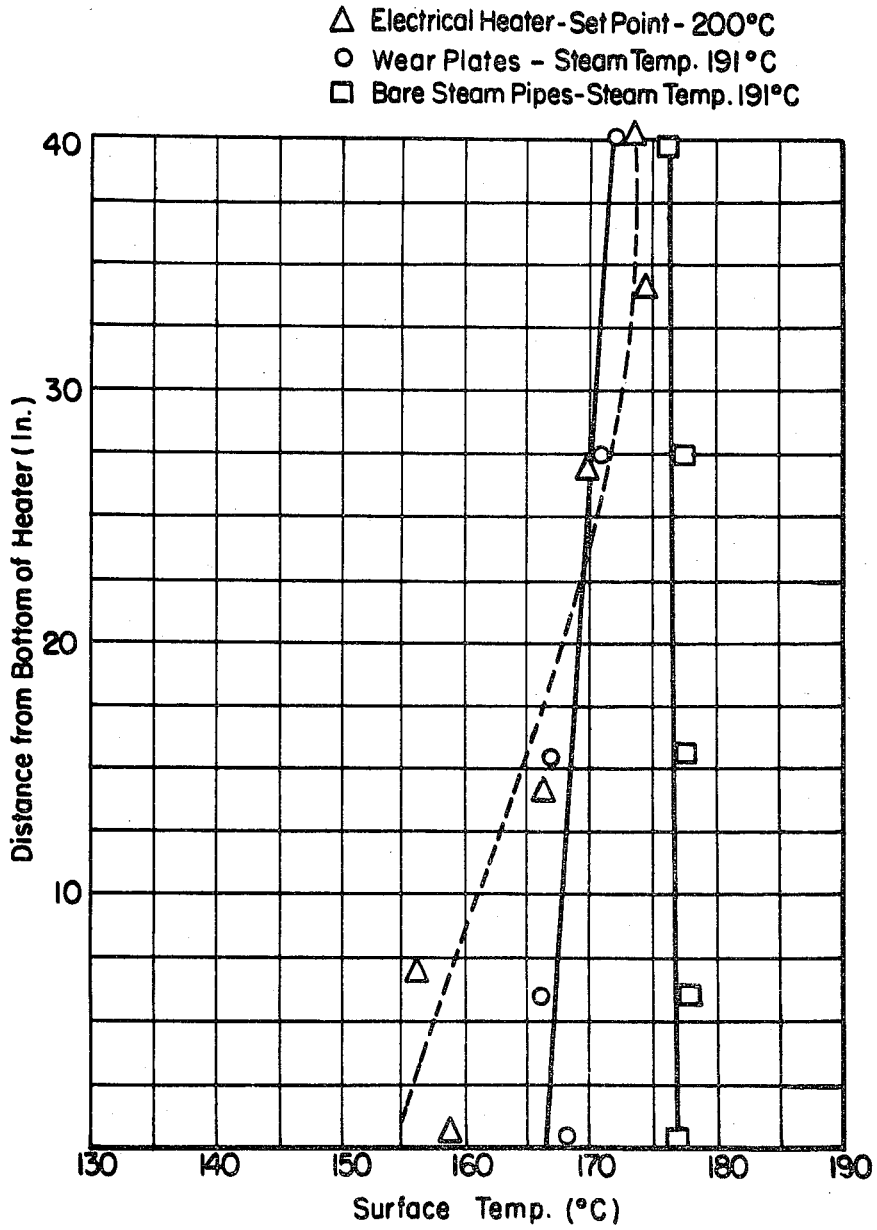
FIGS. 6 and 7 illustrate the much lower temperature gradients obtained with the instant invention in contrast to the prior art.
Figure 7:
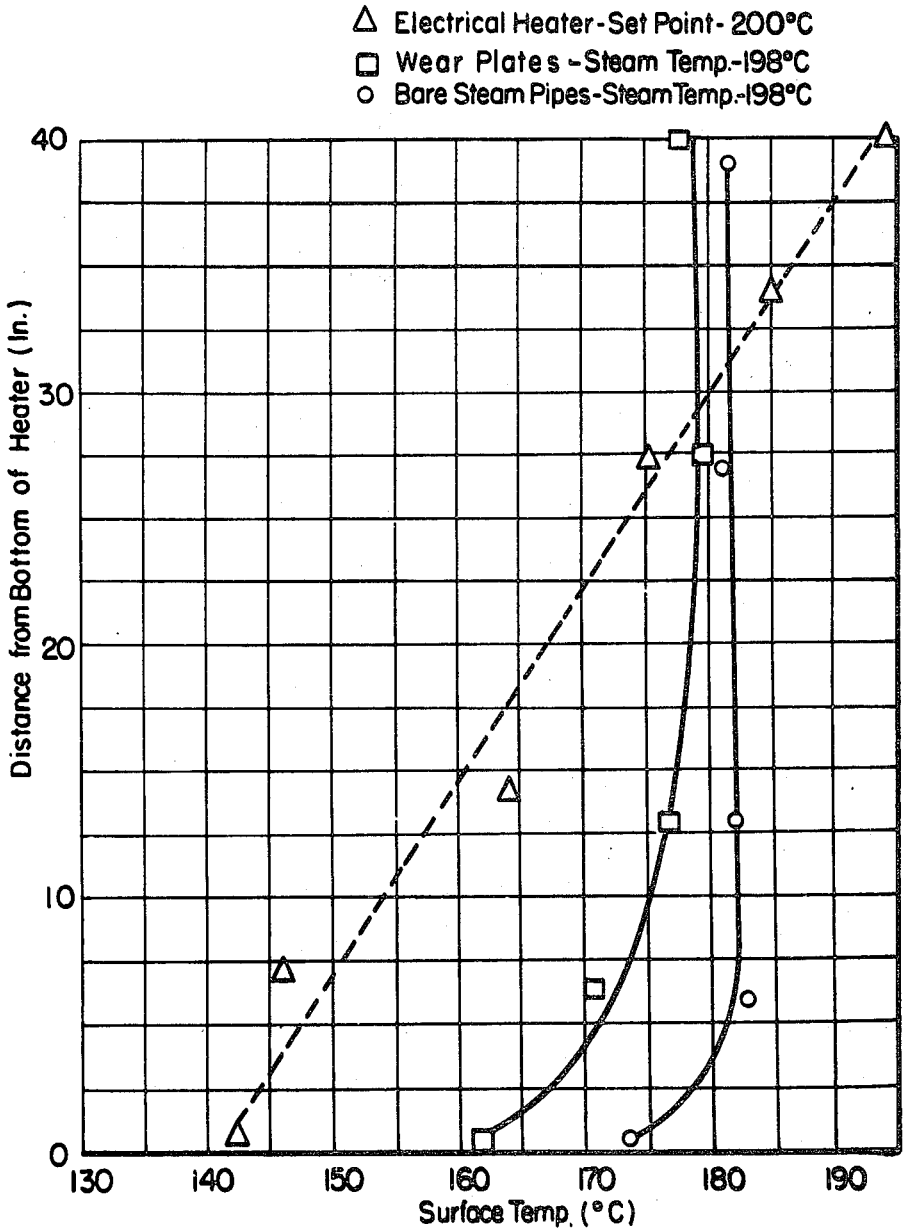

FIGS. 6 and 7 show conclusively the superiority of the vapor system over the electrically heated system and also the superiority of the bare steam pipes over the heaters with removable wear strips. In particular, condensing steam systems without wear strips exhibit a temperature profile from top to bottom which ranges no more than 1° C. compared to 4° C. and 20° C. for condensing steam heaters with wear strips and Barmag electrical heaters respectively.

Similar improvements in temperature profile were obtained over a period of seven weeks when drawtwisting 1000 denier polyester yarn at 3,000 ft./min., with the total temperature range of 275 temperature measurements made on 12 heaters without wear strips being $\pm 3\frac{1}{2}$° C. The process without wear strips has an overall coefficient of heat transfer in excess of 1000 BTU/sq.ft./hr./° F.

Having disclosed the invention, what we claim is:

1. An improved heating apparatus of the multiple condensing-vapor substantially air-free type used for uniformly heating downwardly moving threadlines of yarn up to 350° C. and which includes a pressurized boiler containing a vaporizable liquid comprising at least 99% water, means for heating the liquid in the boiler to generate hot vapor, means for distributing the hot vapor to the inside of multiple plates where the vapor condenses and thereby heats at least two threadlines of yarn separately moved in frictional contact with an outer yarn-contacting surface of each hot plate, and means for returning the condensate to the boiler, wherein the improvement comprises the combination of:

(i) an essentially permanent film-type coating on the inside surface of each said hot plate, said coating having a contact angle with said vaporizable liquid of at least 90° and being promotive of heat transfer; said coating being a filming amine selected from the group consisting of octadecylamine, hexadecylamine and dioctadecylamine;

(ii) said vaporizable liquid comprises up to 100 parts per million of said filming amine; and (iii) each said hot plate comprises a bare steam pipe without a wear strip, whereby there is an overall coefficient of heat transfer from said vapor to said yarns at least 1000 BTU/sq.ft./hr./° F. differential and said heat treated yarns have improved uniformity of properties such that said heat treated yarns made from said twin threadline process can be merged with a heat treated yarn made from a temporary single threadline process resultant from one of said twin threadlines breaking or running out.

2. The apparatus of claim 1 wherein said filming amine is present in an amount from 2 to 15 parts per million.

3. The apparatus of claim 1 wherein said vaporizable liquid includes a neutralizing amine at a concentration up to about 15 parts per million.

4. The apparatus of claim 1 wherein said yarn-contacting surfaces of said hot plates are inclined to a horizontal plane and are substantially under said vapor said hot plates.

5. The apparatus of claim 5 wherein said yarn-contacting surface is inclined at an angle from 45° to 85° to the horizontal and has a length from 2 feet to 10 feet.

6. The apparatus of claim 6 wherein said yarn-contacting surface is inclined at an angle from 55° to 75° to the horizontal and has a length from 3 feet to 6 feet.

7. The apparatus of claim 1 wherein said boiler comprises means for passing an electric current through said vaporizable liquid.

8. The apparatus of claim 1 which comprises inclined hot plates and means for distributing said vapor to the top end of each said inclined hot plate and means for returning said condensate from the bottom end of each hot plate.

* * * * *

UNITED STATES PATENT AND TRADEMARK OFFICE

CERTIFICATE OF CORRECTION

PATENT NO. : 4,176,712

DATED : December 4, 1979

INVENTOR(S) : LEE H. KNOX et al

It is certified that error appears in the above-identified patent and that said Letters Patent are hereby corrected as shown below:

At Title Page, at [62], delete "Pat. No. 3,736,464" and insert --- abandoned ---.

At Column 1, lines 5-6, delete "U.S. Pat. No. 3,736,469" and insert --- abandoned ---.

Signed and Sealed this

*First* Day of *April 1980*

[SEAL]

*Attest:*

SIDNEY A. DIAMOND

*Attesting Officer*

*Commissioner of Patents and Trademarks*